United States Patent [19]

Maeda et al.

[11] Patent Number: 5,065,807

[45] Date of Patent: Nov. 19, 1991

[54] FOLDING DOOR STRUCTURE

[75] Inventors: Kenji Maeda, Kitakyushu; Nobuyuki Yamada, Kokubunji, both of Japan

[73] Assignees: Dantani Co., Ltd., Fukuoka; Murakoshi Screw Mfg. Co., Ltd., Tokyo, both of Japan

[21] Appl. No.: 362,052

[22] Filed: Jun. 6, 1989

[30] Foreign Application Priority Data

Jun. 6, 1988 [JP] Japan ..... 63-75138

[51] Int. Cl.[5] ..... E05D 15/26

[52] U.S. Cl. ..... 160/206; 160/199

[58] Field of Search ..... 160/199, 206, 196.1, 160/236, 201; 16/95, 97, 100, 105, 99, 96

[56] References Cited

U.S. PATENT DOCUMENTS 1,612,443 12/1926 Johnson et al. .
3,102,581 9/1963 Kochanowski ..... 16/97 X
3,277,951 10/1966 Levicke ..... 160/199 X
3,287,759 11/1966 Foltz ..... 160/199 X
3,302,691 2/1967 Andrews et al. ..... 16/97 X

FOREIGN PATENT DOCUMENTS 867747 1/1953 Fed. Rep. of Germany .
656179 6/1986 Switzerland .

*Primary Examiner*—Blair M. Johnson
*Attorney, Agent, or Firm*—Leydig, Voit & Mayer

[57] ABSTRACT

A folding door structure having a folding door, formed by a pair of pivotally coupled door sections, has upper and lower guide rails defining roller support surfaces. An upper guide body supports rollers which are guided along the roller support surfaces of the upper guide rail and a lower guide body has a shaft supporting further rollers which bear against the roller support surfaces of the lower guide rail. The shaft is spring biassed upwardly enabling relative displacement of the rollers and the lower guide body.

4 Claims, 3 Drawing Sheets

FOLDING DOOR STRUCTURE

FIELD OF THE INVENTION

The present invention relates to a folding door structure with a pair of pivotally coupled folding door sections.

BACKGROUND OF THE INVENTION

A folding door structure having a pair of folding door sections which are coupled together by means of hinges or the like can be utilised to open or close the front opening of an enclosure such as a wardrobe, a closet or the like.

A conventional folding door structure used in such furniture is disclosed in Japanese Patent Application Disclosure No. 254,776/86 (corresponding to U.S. Pat. No. 4,726,637) and comprises guide hinges which are mounted for movement along guide rails disposed along the upper and lower front edges of the front opening of a piece of furniture and which support the door sections so that they may be folded back into a condition in which the rear side surfaces thereof overlap each other. The guide hinges are mounted in the outer edges at the top and bottom of each door section.

The guide hinge mounted at the top of a door section comprises a roller mechanism having rollers, rotatable about a horizontal axis, which can move along the guide rail, and further rollers, rotatable about a vertical axis, for determining the position of the door sections in the forward-and rearward directions with respect to the guide rail, and a hinge mechanism which supports the door section and allows it to rotate or swing.

The guide hinge mounted at the bottom portion of a door section comprises a roller mechanism having rollers, rotatable about a vertical axis, for determining the position of the door section in the forward and rearward directions with respect to the guide rail and a hinge mechanism which supports the door section and allows it to rotate or swing.

With this arrangement, when one or both of a pair of door sections which constitute a folding door covering the front portion of an article of furniture are pulled forwards in such a manner as to move them towards the opposite side or towards each other, the roller mechanisms of the upper and lower guide hinges of one or both of the two door sections are caused to move along the guide rails, and at the same time, the two door sections are folded up through the hinge mechanisms of the guide hinges in such a manner that the rear surfaces of the door sections overlap each other, whereby the front portion of the main furniture body is opened.

In the case of conventional folding door structures, constructed as described above, it is necessary to provide guide hinges having hinge mechanisms in order to support the door sections of the folding door and in the case of the upper guide hinge it is necessary to provide rollers which are rotatable about horizontal axes to support the door sections and rollers which are rotatable about vertical axes to determine the position in the forward-rearward directions of the door sections. Thus, the mechanism used to support the door sections is both complex and costly.

Furthermore, when the folding door is opened or closed, i.e. when the upper and lower guide hinges of the door sections are caused to move along the upper and lower guide rails, it is possible that, if a door section does not move correctly, the upper and lower parts of the door section may undergo different amounts of movement. In these circumstances the side edges of the door may slope and the door sections may not run smoothly during the opening and closing movements.

Moreover, since the roller mechanism of the upper and lower guide hinges of the door sections are merely placed on, or in contact with, the guide rails, there is a risk that the rollers may slip off the guide rails.

The present invention aims to alleviate the aforementioned problems, and it is an object of the invention to provide a folding door structure which is so constructed that the means used to support a door section of a folding door is simpler in construction and is less costly and, moreover, is effective to inhibit the door section from becoming inclined and to restore the door section to the correct orientation should it become inclined, so that the door section may be opened and closed smoothly, and the rollers do not slip off the guide rail.

SUMMARY OF THE INVENTION

According to the invention there is provided a folding door structure, comprising a folding door formed by a pair of door sections which are coupled together pivotally along adjacent edges thereof, an upper guide rail disposed above the folding door and being formed with a downwardly facing rail groove defining roller-support surfaces, a lower guide rail disposed below the folding door and being formed with an upwardly facing rail groove defining roller-receiving surfaces and an upper guide body and a lower guide body for each door section, each upper guide body including an upper base member fixed in the upper portion at the outer end side of each respective door section, a support shaft extending upwardly from the upper base member and an upper roller support member mounted on the support shaft so as to be rotatable about a vertical axis, and supporting rollers which are rotatable about a horizontal axis, the rollers being further supported by, and displaceable along, the roller support surfaces of the upper guide rail, and each lower guide body including a lower base member fixed in the lower portion at the outer end side of each respective door section and a lower roller support member mounted on a further support shaft so as to be rotatable about a vertical axis and supporting further rollers which are rotatable about a horizontal axis, the further rollers being in engagement with, and displaceable along, the roller- receiving surfaces of the lower guide rail, wherein the further support shaft is biassed resiliently upwards thereby to permit relative displacement of the lower base member and the rollers supported by the lower roller support member.

The upper and lower roller supporting members which support the rollers of the upper and lower guide bodies are supported by supporting shafts in such a manner that the supporting shafts are rotatable about vertical axes relative to the upper and lower supporting members, and the respective rollers are rollably inserted into the rail grooves of the upper and lower guide rails; therefore there is no necessity to employ complicated means comprising e.g. roller mechanisms which each have rollers directed in different directions and a hinge. The folding door structure according to the present invention is thus simple in construction and less costly, and when a door section is moved so as to open or close the folding door, the upper and lower parts of each door section move correctly due to the effect of the resilient biassing of the support shaft provided in the lower guide body, whereby the outer edge portion of the door section is inhibited from becoming inclined and, even if the outer edge portion of the door section becomes inclined, a restoring force is exerted which causes the door section to assume its normal, vertically upright attitude, as a result of which the door sections can always be opened or closed smoothly. Furthermore, the rollers of the upper and lower guide bodies are inserted into the rail grooves of the upper and lower guide rails, and this ensures that the rollers are prevented from slipping off the guide rails.

A folding door structure in accordance with the present invention operates as follows: When one of the door sections is moved towards the other door section or when both door sections are moved towards each other so as to be drawn out forwardly, the rollers of the upper guide bodies of one or both of the door sections are caused to roll in the rail groove of the upper guide rail, and at the same time, each support shaft rotates with respect to the respective upper roller supporting member which supports said rollers, as a result of which the door sections open. Similarly, the rollers of the lower guide bodies of the door sections roll in the rail groove of the lower guide rail, and at the same time, each supporting shaft rotates with respect to the respective lower roller supporting member which supports said rollers, as a result of which the folding door is folded up in such a manner that the rear surfaces of the door sections overlap each other. When the door sections are moved to open or close the folding door, the lower portion of each door section follows the upper portion of the door section due to the spring force of the spring in the lower guide body. That is, the spring biasing force of the spring is the weakest when the door section is held upright in which case the supporting shaft is drawn into the lower base to the maximum extent, whereas when the door section is inclined, the supporting shaft is withdrawn from the lower base, so that the spring biasing force of the spring becomes stronger. Thus, the effect of the spring force is to cause the door section to be maintained in an upright condition.

Thus, it is clear that the present invention tends to maintain the outer edges of the door sections upright, and even if the outer edges of a door section become inclined, they tend to be restored to their normal upright attitude.

DESCRIPTION OF THE PREFERRED EMBODIMENT

Figure 1:
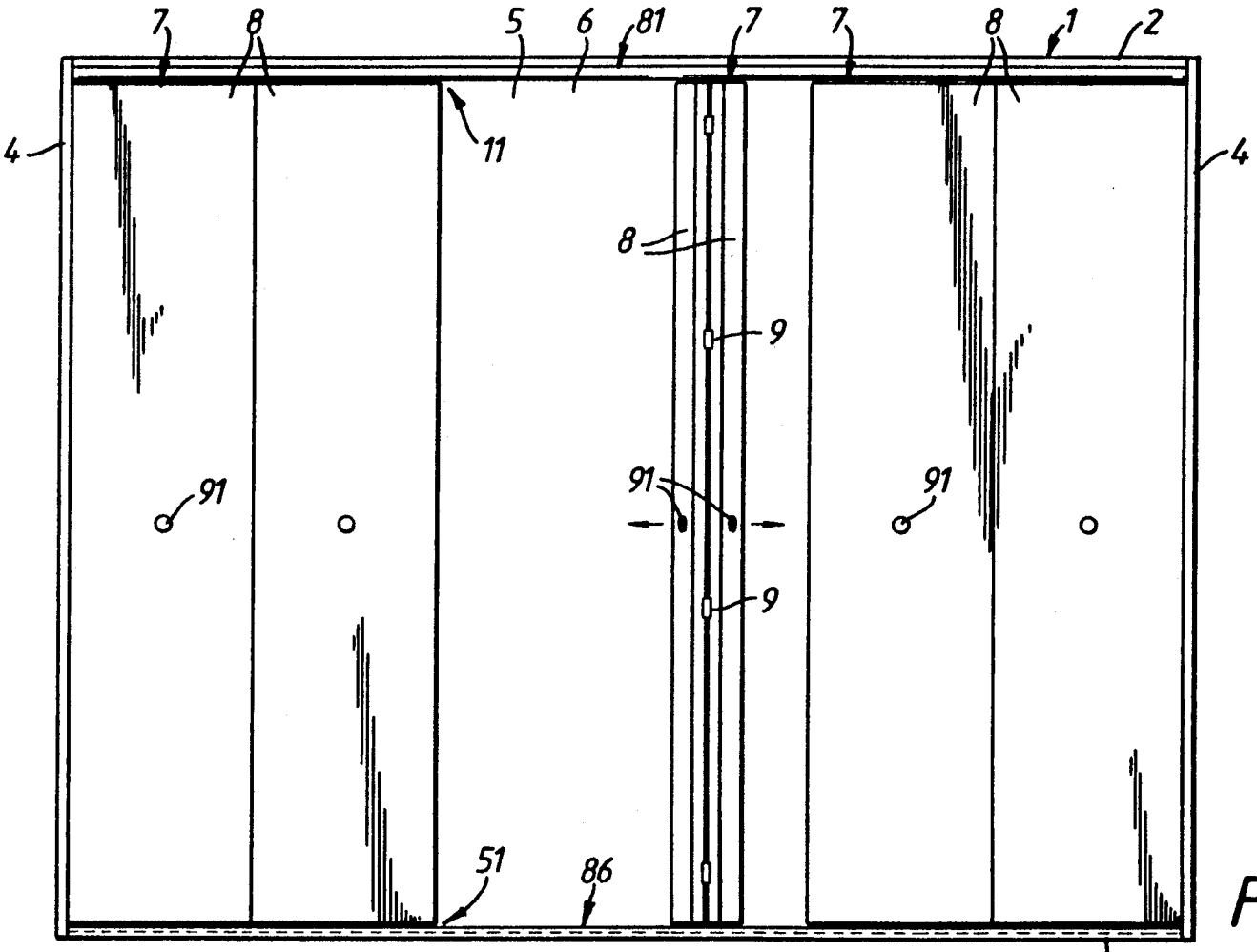
FIG. 1 is a front view showing the folding door structure.
Figure 2:
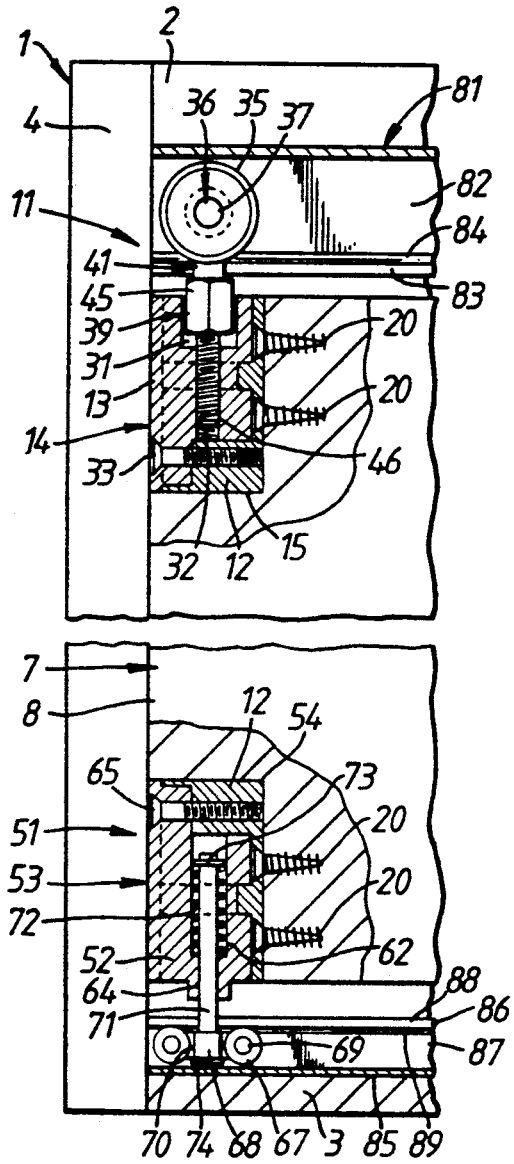
FIG. 2 is a part-sectional view of one side of the folding door structure shown in FIG. 1 as viewed from the front.
Figure 3:
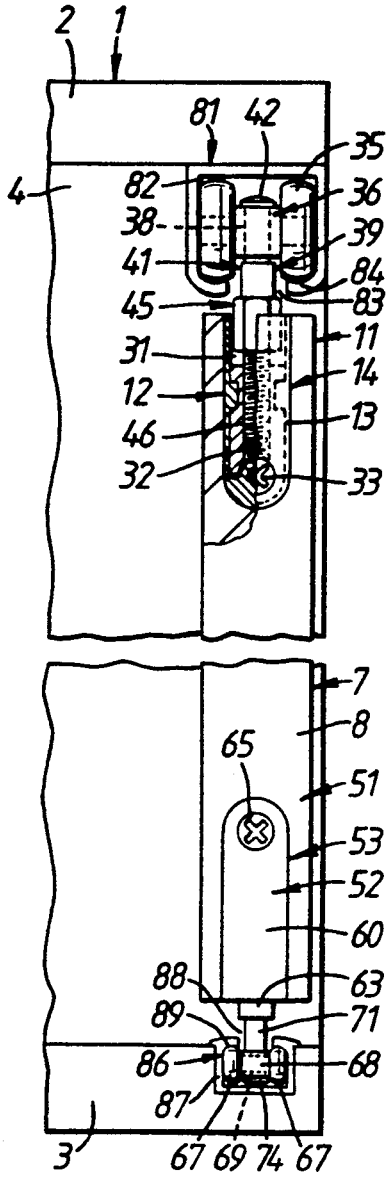
FIG. 3 is a part-sectional view of the same embodiment as viewed laterally.

First, referring to FIGS. 1 to 3, an article 1 of furniture comprises a top plate 2, a bottom plate 3, right- and left-hand side plates 4, and a back plate 5, thus defining an enclosure 6 having a front opening.

The front opening of the enclosure 6 of the article of furniture 1 may be covered by three folding doors 7. Each of said folding doors 7 comprises a pair of upright oblong door sections 8 which can be fitted between an upper guide rail (to be described later) mounted on the top plate 2 and a lower guide rail (to be described later) mounted on the bottom plate 3 of the furniture 1. Adjacent door sections 8 are coupled together by means of a plurality of hinges 9 enabling the door sections to be folded in such a manner that the rear surfaces of the door sections 8 face each other. The above-mentioned hinges are so constructed that the two door sections 8 are maintained resiliently in the closed condition.

In an outer edge portion at the top of each of the door sections 8 of the folding door 7, there is mounted an upper guide body 11, which comprises an upper base 14 consisting of a base cup 12 and an upper inner block 13.

Figure 4:
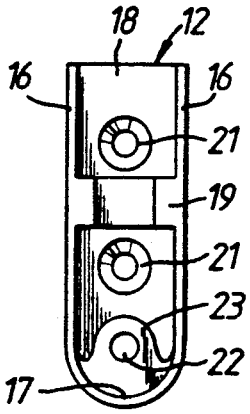
FIG. 4 is an end view of the base cup.
Figure 5:
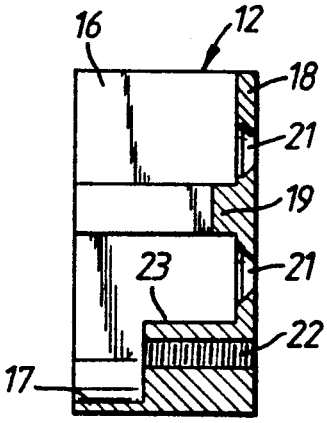
FIG. 5 is a sectional view through the base cup of FIG. 4.

The base cup 12 is set into a groove 15 which is formed as a recess in the side and upper edges of the door section 8. As is best shown in FIGS. 4 and 5, the base cup 12 has a generally U-shaped cross-section comprising side plates 16 and an arcuately-shaped base plate 17. The base cup 12 is further provided with an end plate 18 covering one end face thereof and, in approximately the centre of the two lateral side plates 16 and the end plate 18, a projection 19 is provided. In portions of the end Plate 18 which lie above and below the projection 19 there are formed mounting holes 21 for receiving setscrews 20 which are screwed into the door section 8. Furthermore, the lower part of the end plate 18 has an inwardly projecting mounting boss 23 which has a screw-threaded hole 22 which is parallel to the side plates 16 and 17.

Figure 6:
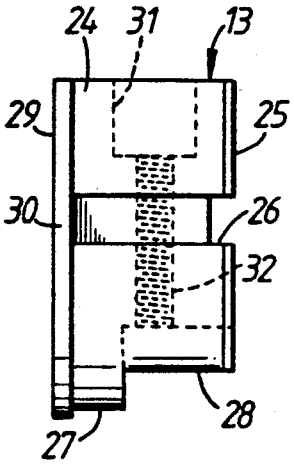
FIGS. 6 and 7 are side and end views respectively showing the upper inner block.
Figure 7:
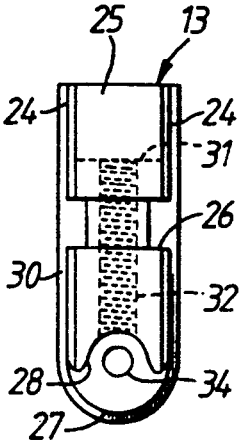

As shown in FIGS. 6 and 7, the inner block 13, has an external shape such that the block 13 fits inside the base cup 12; and in approximately the center of the two side faces 24 and the end face 25 at the fitting or insertion side of the block 13, there is provided a depression 26 which fits against projection 19 of the end face plate 18, and on a bottom face 27, there is provided a depression 28 which fits against the mounting boss 23 of end face plate 18. Furthermore, the angular edge portions at the insertion end of the block 13, that is, the edges defined by the two side faces 24 and the end face 25 are chamferred, and a flange 30 is provided on the peripheral edge portion of an end face 29 at the end opposite to the end face 25. There is further provided a cylindrical groove 31 which is open at the top and a screw-threaded hole 32 extends vertically from the bottom of this groove 31 to the fitting depression 28. In addition, there is provided a horizontal through-hole 34 into which a setscrew 33 (shown in FIGS. 2 and 3) is inserted, the set screw extending through end face 29 and the depression 28 and being screw-engaged with the screw-threaded hole 22.

Figure 8:
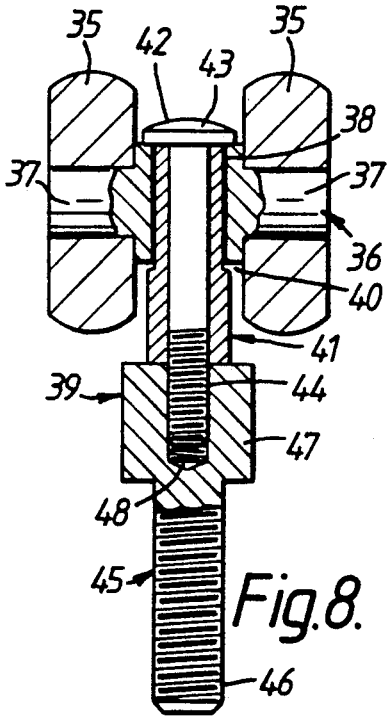
FIG. 8 is a part-sectional view of part of the upper guide body.

As shown in FIG. 8, the upper guide body 11 has a pair of rollers 35, whose outer periphery is arcuate as viewed end on. The rollers are supported on shafts 37 at opposite ends of an upper roller supporting member 36 so as to be rotatable about a horizontal axis. The upper roller supporting member 36 can rotate about a vertical axis with respect to a supporting shaft member 39 mounted on the upper inner block 13. The supporting shaft member 39 has a collar 41, and a relatively narrow part thereof which extends upwardly from a wider part 40 of the collar 41 is rotatably fitted into a hole 38 in the upper roller supporting member 36. Collar 41 is fixedly clamped between the head 43 of a mounting screw 42 which extends within said collar 41 and a mounting bolt 45 with which a screw-threaded end portion 44 of the mounting screw is engaged. The mounting bolt 45 has a screw-threaded shaft 46 which is screwed into the screw-threaded hole 32 in the upper inner block 13. The mounting bolt also has a hexagonal head 47 which can move in groove 31, and a screw-threaded hole 48 provided in the head 47, can receive the screw-threaded portion 44 of the mounting screw 42.

As is also shown in FIGS. 1 to 3, a lower guide body 51 is mounted in the outer edge at the bottom of each of the door sections 8 of the folding door 7 and the lower guide body 51 has a lower base 53 consisting of a said base cup 12 and a lower inner block 52.

The base cup 12, used in the lower guide body 51, is identical to that used in the upper guide body 11 but is inverted. In this case, the base cup 12 is set into a groove 54 formed in the side and lower edges of each door section 8, as shown in FIG. 2.

Figure 9:
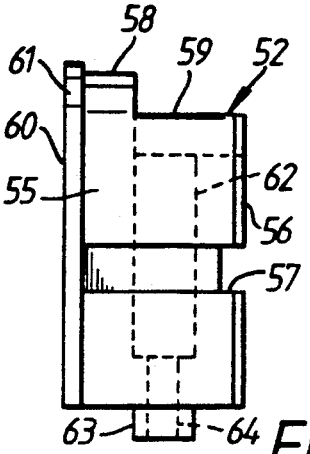
FIGS. 9 and 10 are side and end views respectively showing the lower inner block.
Figure 10:
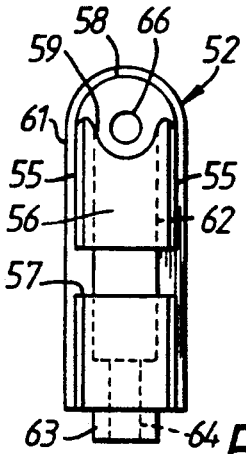

The lower inner block 52 is so shaped externally that it can fit inside the base cup 12 as shown in FIGS. 9 and 10. A depression 57, which fits adjacent the projection 19 of the base cup, is provided approximately centrally with respect to both lateral side faces 55, and the end face 56, at the insertion end of the lower block 52. A depression 59, which fits against the boss 23 of the base cup, is also provided in an upper face 58. Furthermore, the angular edges at the insertion end of block 52, that is, the edges defined by the two side faces 55 and the end face 56, are chamferred, and a flange 61 is provided on the peripheral edge portion of an end face 60 at the end opposite to the end face 56. Moreover, there is further provided a vertical, cylindrical groove 62 which is open at the top. A support hole 64 extends from the bottom of groove 62 and passes through a boss 63 which projects downwardly from the bottom of block 52, and there is further provided a through-hole 66 for receiving a setscrew 65, as shown in FIGS. 2 and 3. The set screw extends through the end face 60 and the fitting depression 59 and is screwed into the screw-threaded hole 22 in the base cup 12.

Moreover, as shown in FIGS. 2 and 3, the lower guide body 51 has four rollers 67 which have arcuate peripheral surfaces as viewed end-on. The rollers 67 are mounted at opposite ends of supporting shafts 68, said rollers 67 being rotatable about respective horizontal axes. The lower roller-supporting member 68 is mounted on a supporting shaft 71 which is itself mounted in the lower block 52. A central fitting hole 70 in the lower roller supporting member 68 permits rotation of the lower block 52 about the longitudinal (vertical) axis of the shaft. The supporting shaft 71 is fitted in a vertically slidable manner in support hole 64 of the lower inner block 52 and is upwardly urged by the spring force of a spring 72 which is disposed in a groove 62 around the supporting shaft 71 and bears against a ring 73 fitted to the upper end of said supporting shaft 71. At the lower end of the supporting shaft 71, there is provided a flange portion 74 which is in contact with the lower surface of the lower roller supporting member 68.

An upper guide rail 81 is mounted along the lower edge of the front end portion of the top plate 2 of the furniture 1. The guide rail 81 has an approximately U-shaped cross section. The guide rail has a downwardly-facing rail groove 82 in which the upper rollers 35 can roll freely, and in the center of the lower face of the guide rail 81, there is formed a through-groove 83 through which the supporting shaft member 39 extends. In both side portions, adjacent the through-groove 83, there are provided roller-receiving surfaces 84 for supporting the arcuately-shaped rollers 35. These roller-receiving faces 84 have an arcuate shape similar to that of the outer peripheral surfaces of the rollers 35.

A lower guide rail 86 is embedded in an embedding groove 85 formed in and along the front end edge portion of the bottom plate 3 of the furniture 1. The lower guide rail 86 has an approximately U-shaped cross section, and a rail groove 87 is provided in the lower guide rail 86 into which the rollers 67 are rollably fitted. In the center of the upper face of the lower guide rail 86, there is provided a through-groove 88 through which the supporting shaft 71 can project. In both side portions, the through-groove 88 defines roller-receiving surfaces 89 for supporting the arcuately-shaped rollers 7. The roller-receiving faces 89 have an arcuate shape similar to that of the outer peripheral surfaces of the rollers 67.

A knob 91 is provided in approximately the center of the surface of each door section 8.

The upper guide body 11 is assembled as follows: the relatively narrow portion of the collar 41 is inserted into the hole 38 in the upper roller supporting member 36, and the mounting screw 42 is passed through collar 41 and fixedly screw-engaged with the head portion 47 of the mounting bolt 45. The mounting bolt 45 is then screwed into the screw-threaded hole 32 of the upper inner block 13 from the top thereof.

The lower guide body 51 is assembled as follows: The support shaft 71 is inserted from below into the support hole 64 of the lower inner block 52 through the lower roller supporting member 68 and spring 72 is introduced into groove 62 of the lower inner block 52 around the supporting shaft 71 and is held by the ring 73.

Then, the folding door 7 is mounted in such a manner that the base cups 12 are fitted into the upper and lower recesses 15 and 54 of the respective door sections 8, and the setscrews 20 are screwed into the door sections 8 through the respective mounting holes 21, whereby the respective base cups 12 are fixed.

On the other hand, the rollers 35 of the thus assembled upper guide body 11 may be inserted into the rail groove 82 of the upper guide rail 81 from one end of said groove 82, and the upper guide rail 81 then fixed to the top plate 2 of the furniture 1 by means of screws or the like. Similarly, the rollers 67 of the lower guide body 51 could be inserted, from one end, into the rail groove 87 of the lower guide rail 86, the guide rail 86 being then set into the groove 85 in the bottom plate 3 of the furniture 1 and fixed by means of screws or the like.

Then, the door sections 8 are fitted between the upper guide rail 81 and the lower guide rail 86, the upper inner block 13 of the upper guide body 11 being introduced sideways into the base cup 12, fixed to the upper portion of the door section 8, with the depression 26 and the fitting depression 28 of the upper inner block 13 fitting against the projection 19 and the mounting boss 23 respectively, and the setscrew 33 being inserted into the throughhole 34 of the upper inner block 13, screw-engaged with the screw-threaded hole 22 of the base cup 12, and fixedly clamped. Similarly, the lower inner block 52 of the lower guide body 51 is introduced sideways into the base cup 12 and fixed to the lower portion of the door section 8, with the depression 57 and the fitting depression 59 of the lower inner block 52 fitting against projection 19 and the mounting boss 23 respectively, and the setscrew 65 being inserted into the throughhole 66 of the lower inner block 52, screw-engaged with the screw-threaded hole 22 of the base cup 12, and fixedly clamped.

The folding door 7 can alternatively be mounted onto the furniture 1 as follows: First the respective guide bodies 11 and 51 are mounted on each of the door sections 8 of the folding door 7, and the respective rollers 35 and 67 of the guide bodies 11 and 51 are fitted into the guide rails 81 and 86 previously mounted on the furniture 1. Since the rollers 35 and 67 are fitted after the respective guide rails 81 and 86 are mounted on the furniture 1, the end portions of the respective guide rails 81 and 86 may, for example, be suitably cut away so as to allow the rollers 35 and 67 to be easily fitted. After respective rollers 35 and 67 have been fitted to the guide rails 81 and 86, end rail portions are attached to the thus cut-away end portions of the guide rails 81 and 86.

Furthermore, when the folding door 7 is mounted on the furniture 1, the amount by which the mounting bolt 45 projects upwardly with respect to the upper inner block 13 of the upper guide body 11 can be adjusted by rotating the mounting bolt 45 of supporting shaft member 39 of the upper guide body 11, thus making it possible to adjust the height of the folding door 7 with respect to the furniture 1.

Each door section 8, thus mounted, is suspended from the upper guide rail by the upper guide body 11 and is urged downwardly by the spring 72 provided in the lower guide body 51, whose rollers 67 fit inside the lower guide rail 86. Moreover, the supporting shaft member 39 of the upper guide body 11 and the supporting shaft 71 of the lower guide body 51 are positioned along one and the same axial line on each door section 8, about which the door sections 8 can turn, during the opening and closing movements.

When the folding door 7 is in the closed condition, the respective door sections 8 thereof are held by means of the hinges 9 in end-to-end relationship; and in this way, all the folding doors 7 are arranged substantially in a common plane, whereby door structure completely covers the front portion of the housing space 6 of the furniture 1.

The folding door 7 is opened as follows: The user holds the knob 91 of, for instance, the left-hand door section 8 and pulls the door section forwards causing it to move towards the adjacent right-hand door section, whereby the rollers 35 of the upper guide body 17 of the left-hand side door section 8 roll within, and along, the rail groove 82 of the guide rail 81. At the same time, the supporting shaft member 39 rotates relative to the upper roller supporting member 36 which supports rollers 35, whereby the above-mentioned door section 8 pivots and is caused to open. Similarly, rollers 67 of the lower guide body 51 of the left-hand door section 8 roll within, and along, the rail groove 87 of the lower guide rail 86, and at the same time, the supporting shaft 71 rotates relative to the lower roller supporting member 68 which supports said rollers 67, whereby the above-mentioned door section 8 pivots and is caused to open. In this way the folding door 7 is caused to move to the right in the drawings, and is folded up with the rear surfaces of the two folded door sections 8 facing each other. Thus, that portion of the front side of the housing space 6 which extends leftwards from the folding door 7 is opened.

Since the opening operation of the folding door 7 is based on the fact that the two door sections 8 are able to move due to the respective guide bodies 11 and 51, it is also possible to open the folding door 7 in such a manner that the right-hand door section 8 is moved towards the left-hand door section 8 to fold up the folding door, thus opening that portion of the front side of the housing space 6 to the right of the folded door 7. It is further possible to move both door sections 8 toward each other at the same time, so that those parts of the front portion of the housing space 6 which lie to either side of the folding door 7, thus folded, are opened.

Then, the folding door 7, thus folded, can be moved to the right and to the left, in the thus folded state, across the front of the housing space 6. It is also possible to ensure that all the folding doors 7 are folded up and moved to one side of the housing space 6, whereby the front portion of the housing space 6 can be opened much more widely.

Moreover, each folding door 7 can be moved to the right and to the left across the front portion of the housing space 6 even when both door sections 8 are in the closed condition.

Also, when a door section 8 is moved in order to open or close the folding door 7, it could happen that, because a door section is not moving correctly the upper part of the door section 8 and the lower part of the door section 8 are displaced by different amounts, as a result of which the edges of the door section 8 are inclined. Should this happen the door sections 8 would not open and close smoothly. However, the present invention ensures that the lower portion of a door section 8 must follow the upper portion of the door section 8 due to the force of the spring 72 provided in the lower guide body 51. More specifically, the spring 72 is extended to the maximum extent when the door section 8 is held upright, but, should the door section 8 be inclined, the supporting shaft 71 is withdrawn causing the spring 72 to be compressed thereby increasing its resilience. Thus the door section 8 is restored, by the thus intensified spring biasing force of the spring 71, to an upright condition. This tends to prevent the door section from being inclined, and even if said outer end edge portion is inclined, the effect of the resilient biassing means is to restore the door to its normal, upright condition. In this way, the door sections 8 can always be opened and closed smoothly.

Since the rollers 35 and 67 of the respective guide bodies 11 and 51 fit within the rail grooves 82 and 87 of the guide rails 81 and 86, respectively, the rollers 35 and 67 are prevented from slipping off the rails 81 and 86.

It will be understood that although, in the above-described embodiment, the folding doors are mounted on an article of furniture 1, the present invention is not restricted to this application. For example, the invention could also be used to partition a room, in which case, even if a plurality of such folding doors are used, all of them could be folded up and moved to one side. Thus it is clear that folding door structures in accordance with the present invention can be used to good advantage.

What we claim is:

1. A folding door structure, comprising a folding door formed by a pair of door sections which are coupled together pivotally along adjacent edges thereof, an upper guide rail disposed above the folding door and being formed with a downwardly facing rail groove defining roller-support surfaces, a lower guide rail disposed below the folding door and being formed with an upwardly facing rail groove defining roller-receiving surfaces and an upper guide body and a lower guide body for each door section, each upper guide body including an upper base member fixed in the upper portion at the outer end side of each respective door section, a support shaft extending upwardly from the upper base member and an upper roller support member mounted on the support shaft so as to be rotatable about a vertical axis and supporting rollers which are rotatable about a horizontal axis, the rollers being further supported by, and displaceable along, the roller support surfaces of the upper guide rail, and each lower guide body including a lower base member fixed in the lower portion at the outer end side of each respective door section and lower roller support member mounted on a further support shaft so as to be rotatable about a vertical axis and supporting further rollers which are rotatable about a horizontal axis, the further rollers being in engagement with, and displaceable along, the roller-receiving surfaces of the lower guide rail, the further support shaft being biassed resiliently upwards by a spring housed within the lower base member thereby to permit relative displacement of the lower base member and the rollers supported by the lower roller support member, and wherein each said upper base member and each said lower base member comprises a cup fixed within a respective groove formed in the door section and a block so configured as to fit inside the cup, and the cup has an internal projection and the block has a complementarily shaped recess.

2. A folding door structure as claimed in claim 1, wherein the internal projection is an inwardly projecting boss.

3. A folding door structure, comprising a folding door formed by a pair of door sections which are coupled together pivotally along adjacent edges thereof, an upper guide rail disposed above the folding door and being formed with a downwardly facing rail groove defining roller-support surfaces, a lower guide rail disposed below the folding door and being formed with an upwardly facing rail groove defining roller-receiving surfaces and an upper guide body and a lower guide body for each door section, each upper guide body including an upper base member fixed in the upper portion at the outer end side of each respective door section, a support shaft extending upwardly from the upper base member and an upper roller support member mounted on the support shaft so as to be rotatable about a vertical axis and supporting rollers which are rotatable about a horizontal axis, the rollers being further supported by, and displaceable along, the roller support surfaces of the upper guide rail, and each lower guide body including a lower base member fixed in the lower portion at the outer end side of each respective door section and a lower roller support member mounted on a further support shaft so as to be rotatable about a vertical axis and supporting further rollers which are rotatable about a horizontal axis, the further rollers being in engagement with, and displaceable along, the roller-receiving surfaces of the lower guide rail wherein the further support shaft is biassed resiliently upwards thereby to permit relative displacement of the lower base member and the rollers supported by the lower roller support member, and wherein each said upper base member and each said lower base member comprises a cup fixed within a respective groove formed in the door section and a block so configured as to fit inside the cup, and the cup has an internal projection and the block has a complementarily shaped recess.

4. A folding door structure as claimed in claim 3, wherein the internal projection is an upwardly projecting boss.

* * * * *